US007958721B2

(12) United States Patent
Craig et al.

(10) Patent No.: US 7,958,721 B2
(45) Date of Patent: Jun. 14, 2011

(54) REGENERATION SYSTEM HAVING INTEGRAL PURGE AND IGNITION DEVICE

(75) Inventors: Mark William Craig, Dunlap, IL (US); Justin Werner McMenamy, Chillicothe, IL (US); Glenn Brian Cox, Peoria, IL (US); Andrew John Kieser, Peterborough (GB); Ronald Dean Shinogle, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 970 days.

(21) Appl. No.: 11/819,882

(22) Filed: Jun. 29, 2007

(65) Prior Publication Data

US 2009/0000605 A1 Jan. 1, 2009

(51) Int. Cl.
*F01N 3/00* (2006.01)

(52) U.S. Cl. ..... 60/286; 60/274; 60/295; 60/297; 60/303

(58) Field of Classification Search ..... 60/274, 60/286, 295, 297, 300, 303, 311
See application file for complete search history.

(56) References Cited

U.S. PATENT DOCUMENTS

| | | | | |
|---|---|---|---|---|
| 1,375,646 | A * | 4/1921 | Belinski | 431/208 |
| 3,762,378 | A * | 10/1973 | Bitonti | 123/557 |
| 4,533,316 | A | 8/1985 | Takino et al. | |
| 4,622,811 | A | 11/1986 | Distel et al. | |
| 4,787,349 | A | 11/1988 | Hilger | |
| 4,834,043 | A | 5/1989 | Kaczynski et al. | |
| 4,870,943 | A * | 10/1989 | Bradley | 123/558 |
| 4,987,738 | A * | 1/1991 | Lopez-Crevillen et al. | 60/286 |
| 5,001,899 | A | 3/1991 | Santiago et al. | |
| 5,263,325 | A * | 11/1993 | McVey et al. | 60/738 |
| 5,353,591 | A * | 10/1994 | Kabasin et al. | 60/274 |
| 5,571,484 | A * | 11/1996 | Pettit et al. | 422/173 |
| 5,665,318 | A | 9/1997 | Rembold et al. | |
| 5,771,689 | A | 6/1998 | Bareis et al. | |
| 5,832,715 | A * | 11/1998 | Dev | 60/804 |
| 5,992,141 | A | 11/1999 | Berriman et al. | |
| 6,125,624 | A | 10/2000 | Prociw | |
| 6,289,869 | B1 | 9/2001 | Elliott | |
| 6,439,191 | B1 | 8/2002 | Elliott | |
| 6,592,052 | B2 * | 7/2003 | Hokao | 239/135 |
| 6,688,533 | B2 | 2/2004 | Nines et al. | |
| 6,698,191 | B2 * | 3/2004 | Xu et al. | 60/286 |
| 6,823,663 | B2 | 11/2004 | Hammerle et al. | |
| 7,000,383 | B2 | 2/2006 | van Nieuwstadt et al. | |
| 7,406,822 | B2 * | 8/2008 | Funke et al. | 60/297 |

(Continued)

FOREIGN PATENT DOCUMENTS

DE 42 30056 3/1994

(Continued)

OTHER PUBLICATIONS

U.S. Appl. No. 11/979,709, filed Nov. 7, 2007, "Fluid Injector Having Purge Heater," pp. 1-29, Figs. 1-6.

(Continued)

*Primary Examiner* — Binh Q Tran
(74) *Attorney, Agent, or Firm* — Finnegan, Henderson, Farabow, Garrett & Dunner LLP

(57) ABSTRACT

A regeneration device is disclosed. The regeneration device has an injector configured to inject pressurized fuel during an injection event. The regeneration device also has a heater configured to ignite the pressurized fuel during the injection event. The heater is also configured to purge the injector between injection events.

20 Claims, 5 Drawing Sheets

U.S. PATENT DOCUMENTS

| | | | | |
|---|---|---|---|---|
| 7,481,048 | B2 * | 1/2009 | Harmon et al. | 60/303 |
| 7,509,799 | B2 | 3/2009 | Amou et al. | |
| 7,685,810 | B2 | 3/2010 | Hirata et al. | |
| 2004/0098973 | A1 | 5/2004 | Tennison et al. | |
| 2004/0098975 | A1 | 5/2004 | van Nieuwstadt et al. | |
| 2006/0156733 | A1 | 7/2006 | Prociw et al. | |
| 2008/0209890 | A1 | 9/2008 | Cox et al. | |
| 2008/0209897 | A1 | 9/2008 | Urven et al. | |

FOREIGN PATENT DOCUMENTS

| | | | |
|---|---|---|---|
| DE | 19855385 | | 6/2000 |
| DE | 10330913 | | 1/2005 |
| DE | 103 42 003 | | 3/2005 |
| DE | 102006025332 | | 12/2007 |
| EP | 1 655 463 | | 5/2006 |
| GB | 2386845 | | 10/2003 |
| JP | 59 000517 | | 1/1984 |
| JP | 61119918 | A | 6/1986 |
| JP | 95018549 | B | 3/1995 |
| JP | 2005 180371 | | 7/2005 |
| JP | 05 033629 | | 5/2006 |
| WO | 2005025725 | | 3/2005 |
| WO | WO 2005/070175 | | 8/2005 |

OTHER PUBLICATIONS

U.S. Appl. No. 11/979,711, filed Nov. 7, 2007, "Method of Purging Fluid Injector by Heating," pp. 1-29, Figs. 1-6.

Office Action mailed Jul. 21, 2010 for U.S. Appl. No. 11/979,711 (8 pages).

* cited by examiner

REGENERATION SYSTEM HAVING INTEGRAL PURGE AND IGNITION DEVICE

TECHNICAL FIELD

The present disclosure is directed to a regeneration system and, more particularly, to a regeneration system having an integral device that functions to purge a fuel injector during a cleaning event and ignite fuel during an injection event.

BACKGROUND

Engines, including diesel engines, gasoline engines, gaseous fuel powered engines, and other engines known in the art exhaust a complex mixture of air pollutants. These air pollutants include solid material known as particulate matter or soot. Due to increased attention on the environment, exhaust emission standards have become more stringent and the amount of particulate matter emitted from an engine is regulated depending on the type of engine, size of engine, and/or class of engine.

One method implemented by engine manufacturers to comply with the regulation of particulate matter exhausted to the environment has been to remove the particulate matter from the exhaust flow of an engine with a device called a particulate trap or diesel particulate filter. A particulate trap is a filter designed to trap particulate matter and typically consists of a wire mesh or ceramic honeycomb medium. Although initially the particulate trap may adequately remove particles, the use of the particulate trap for extended periods of time may cause the particulate matter to build up in the medium, thereby reducing the functionality of the filter and subsequent engine performance.

The collected particulate matter may be removed from the filter through a process called regeneration. To initiate regeneration of the filter, the temperature of the particulate matter trapped within the filter must be elevated to a combustion threshold, at which the particulate matter is burned away. One way to elevate the temperature of the particulate matter is to inject an energy source, such as diesel fuel, into the exhaust flow of the engine and ignite the injected fuel. Ignition is typically achieved by way of a spark plug.

After the regeneration event, the supply of fuel is shut off. However, some fuel may remain within the fuel injector or the fuel lines that direct fuel to the injector. This remaining fuel, when subjected to the harsh conditions of the exhaust stream, may coke or be partially burned, leaving behind a solid residue that can restrict or even block the fuel injector. In addition, it may be possible for particulate matter from the exhaust flow to enter and block the injector. For this reason, it may be necessary to periodically purge the injector of fuel and/or any built up residue or particulate matter between regeneration events.

One method of purging a fuel injector is described in U.S. Pat. No. 4,533,316 (the '316 patent) issued to Takino et al. on Aug. 6, 1985. Specifically, the '316 patent discloses a combustion apparatus of a fuel vaporizing type, wherein fuel (kerosene) is supplied to a fuel injector for vaporization, and the vaporized fuel is fed to a burner via a gas nozzle for combustion. Combustion is achieved when the gas fuel from the fuel injector is fired with a spark discharge originating from an ignitor.

While the kerosene is being vaporized within the fuel injector of the '316 patent, the kerosene is reduced slowly into tar due to polymerization of molecules, microscopic residues (impurities), etc. As the tar is attached and deposited in the vaporizing core of the fuel injector, a passage for the vaporized kerosene is gradually choked with the tar, so that the proportion of the vaporized oil gas decreases and the rate of combustion slows down, causing a faulty combustion state. To solve this problem, the combustion apparatus is characterized by a heater for removing tar at a high temperature, which is attached within the fuel injector.

The heater is seated tightly on a side wall of the fuel injector body and constantly biased toward the fuel injector body by the force of a spring. During a normal combustion state, the heater operates so as to maintain the interior of the fuel injector at a temperature of 240 degrees to 280 degrees C. under the control of a temperature-monitoring element (typically, a positive characteristic thermistor) and an electronic control. When it is desired to conduct a fuel-empty burning (to remove tar), the temperature-monitoring element is short-circuited, interrupting operation of the electronic control, and establishing a continued heating mode. Consequently, the temperature in the fuel injector reaches 500 degrees C. and tar attached to the vaporizing cylinder of the fuel injector is thermally dissolved and finally removed. When fuel-empty burning is effected, the residual fuel in an associated fuel tank should be removed.

Although the fuel injector of the '316 patent may benefit from the tar removing process described above, the gain may be expensive. In particular, the fuel injector of the '316 patent requires a heater for cleaning the injector and a separate ignitor for normal operation. Having a separate heater and ignitor may increase component cost and assembly time. Furthermore, because the '316 patent recommends the removal of the fuel from the fuel tank, operation of the injector may be periodically interrupted. The fuel injector of the present disclosure solves one or more of the problems set forth above.

SUMMARY OF THE DISCLOSURE

In one aspect, the present disclosure is directed to a regeneration device. The regeneration device may include an injector configured to inject pressurized fuel during an injection event. The regeneration device may also include a heater configured to ignite the pressurized fuel during the injection event. The heater may further be configured to purge the injector between injection events.

In yet another aspect, the present disclosure is directed to a method of operating an injector. This method may include pressurizing fuel and injecting the pressurized fuel during an injection event. This method also may include heating the injector to purge the injector between injection events. Heating the injector to purge the injector also ignites the fuel of a subsequent injection event.

DETAILED DESCRIPTION

Figure 1:
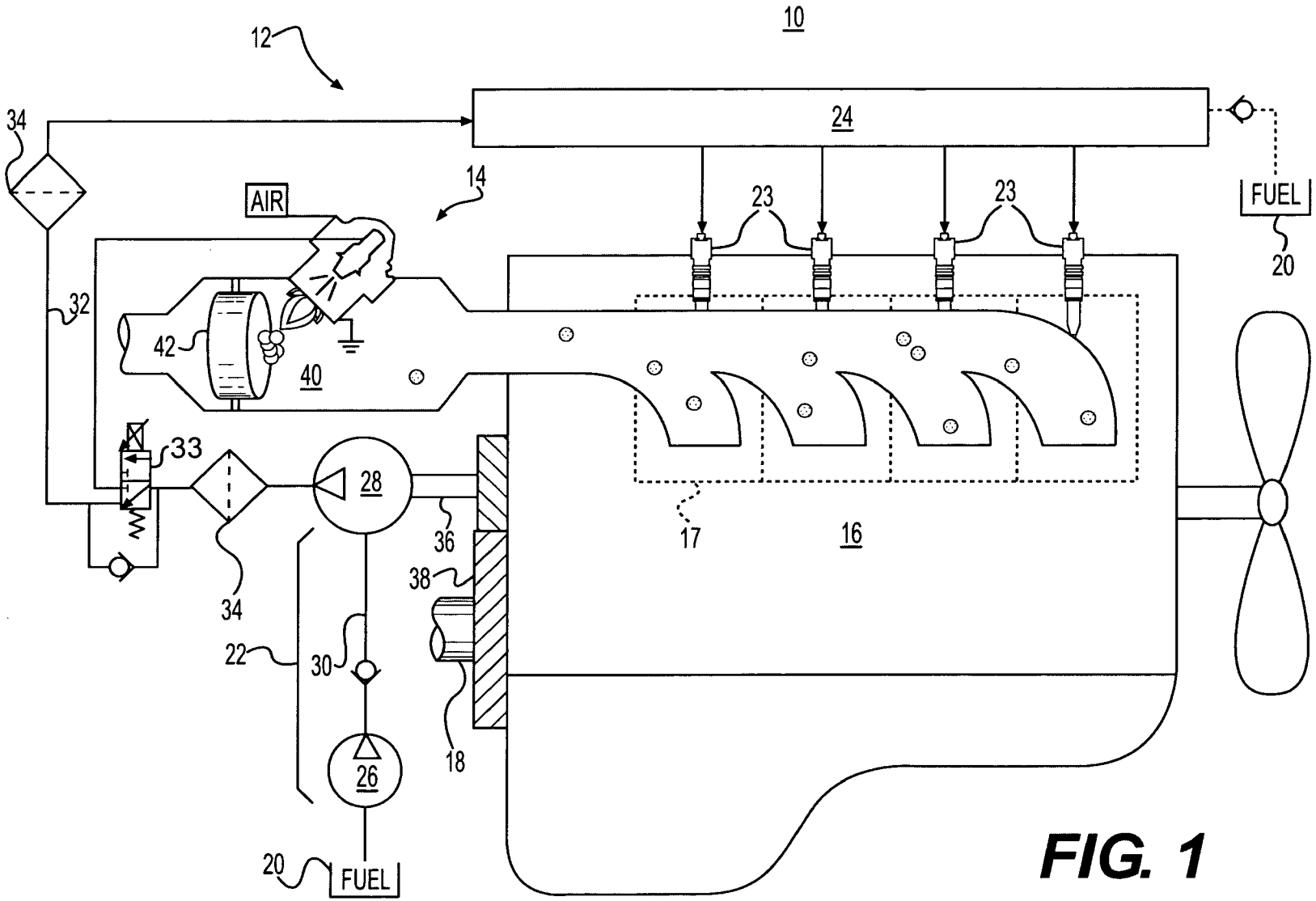
FIG. 1 is a schematic and diagrammatic illustration of an exemplary disclosed power unit.

FIG. 1 illustrates a power unit 10 having a fuel system 12 and an auxiliary regeneration system 14. For the purposes of this disclosure, power unit 10 is depicted and described as a four-stroke diesel engine. One skilled in the art will recognize, however, that power unit 10 may be any other type of internal combustion engine, such as, for example, a gasoline or a gaseous fuel-powered engine. Power unit 10 may include an engine block 16 that at least partially defines a plurality of combustion chambers 17. In the illustrated embodiment, power unit 10 includes four combustion chambers 17. However, it is contemplated that power unit 10 may include a greater or lesser number of combustion chambers 17 and that combustion chambers 17 may be disposed in an "in-line" configuration, a "V" configuration, or any other suitable configuration.

As also shown in FIG. 1, power unit 10 may include a crankshaft 18 that is rotatably disposed within engine block 16. A connecting rod (not shown) may connect a plurality of pistons (not shown) to crankshaft 18 so that a sliding motion of each piston within the respective combustion chamber 17 results in a rotation of crankshaft 18. Similarly, a rotation of crankshaft 18 may result in a sliding motion of the pistons.

Fuel system 12 may include components that cooperate to deliver injections of pressurized fuel into each of combustion chambers 17. Specifically, fuel system 12 may be a common rail system and include a tank 20 configured to hold a supply of fuel, and a fuel pumping arrangement 22 configured to pressurize the fuel and direct the pressurized fuel to a plurality of fuel injectors 23 by way of a rail 24.

Fuel pumping arrangement 22 may include one or more pumping devices that function to increase the pressure of the fuel and direct one or more pressurized streams of fuel to rail 24. In one example, fuel pumping arrangement 22 includes a low pressure source 26 and a high pressure source 28 disposed in series and fluidly connected by way of a fuel line 30. Low pressure source 26 may embody a transfer pump that provides low pressure feed to high pressure source 28. High pressure source 28 may receive the low pressure feed and increase the pressure of the fuel. High pressure source 28 may be connected to rail 24 by way of a fuel line 32. One or more filtering elements 34, such as a primary filter and a secondary filter, may be disposed within fuel line 32 in a series relation to remove debris and/or water from the fuel pressurized by fuel pumping arrangement 22.

One or both of low and high pressure sources 26, 28 may be operatively connected to power unit 10 and driven by crankshaft 18. Low and/or high pressure sources 26, 28 may be connected with crankshaft 18 in any manner readily apparent to one skilled in the art where a rotation of crankshaft 18 will result in a corresponding driving rotation of a pump shaft. For example, a pump driveshaft 36 of high pressure source 28 is shown in FIG. 1 as being connected to crankshaft 18 through a gear train 38. It is contemplated, however, that one or both of low and high pressure sources 26, 28 may alternatively be driven electrically, hydraulically, pneumatically, or in any other appropriate manner. It is further contemplated that fuel system 12 may alternatively embody another type of fuel system such as, for example, a mechanical unit fuel injector system or a hydraulic unit fuel injector system where the pressure of the injected fuel is generated or enhanced within individual injectors without the use of a high pressure source.

A fuel valve 33 may control the flow rate of fuel from fuel pumping arrangement 22 to auxiliary regeneration system 14 and from fuel pumping arrangement 22 to rail 24. In one example, fuel valve 33 may be solenoid actuated against a spring bias to move between a first position, at which fuel is allowed to flow to rail 24 and a second position, at which fuel is allowed to flow to auxiliary regeneration system 14. It is contemplated that fuel valve 33 may alternatively be replaced with multiple independent metering valves to allow fuel to flow to rail 24 and auxiliary regeneration system 14 simultaneously. It is further contemplated that fuel valve 33 may alternatively be pilot actuated, mechanically actuated, or actuated in any other suitable manner.

Auxiliary regeneration system 14 may be associated with an exhaust treatment device 40. In particular, as exhaust from power unit 10 flows through exhaust treatment device 40, exhaust constituents such as particulate matter, NOx, HC, and other constituents may be removed from the exhaust flow or otherwise converted to innocuous gases. In one example, exhaust treatment device 40 may include a wire mesh or ceramic honeycomb filtration medium 42 situated to remove particulate matter from the exhaust flow. Over time, the particulate matter may build up in filtration medium 42 and, if left unchecked, the particulate matter buildup could be significant enough to restrict or even block the flow of exhaust through exhaust treatment device 40, allowing backpressure within the power unit 10 to increase. An increase in the backpressure of power unit 10 may reduce the power unit's ability to draw in fresh air, resulting in decreased performance, increased exhaust temperatures, and poor fuel consumption.

Figure 2:
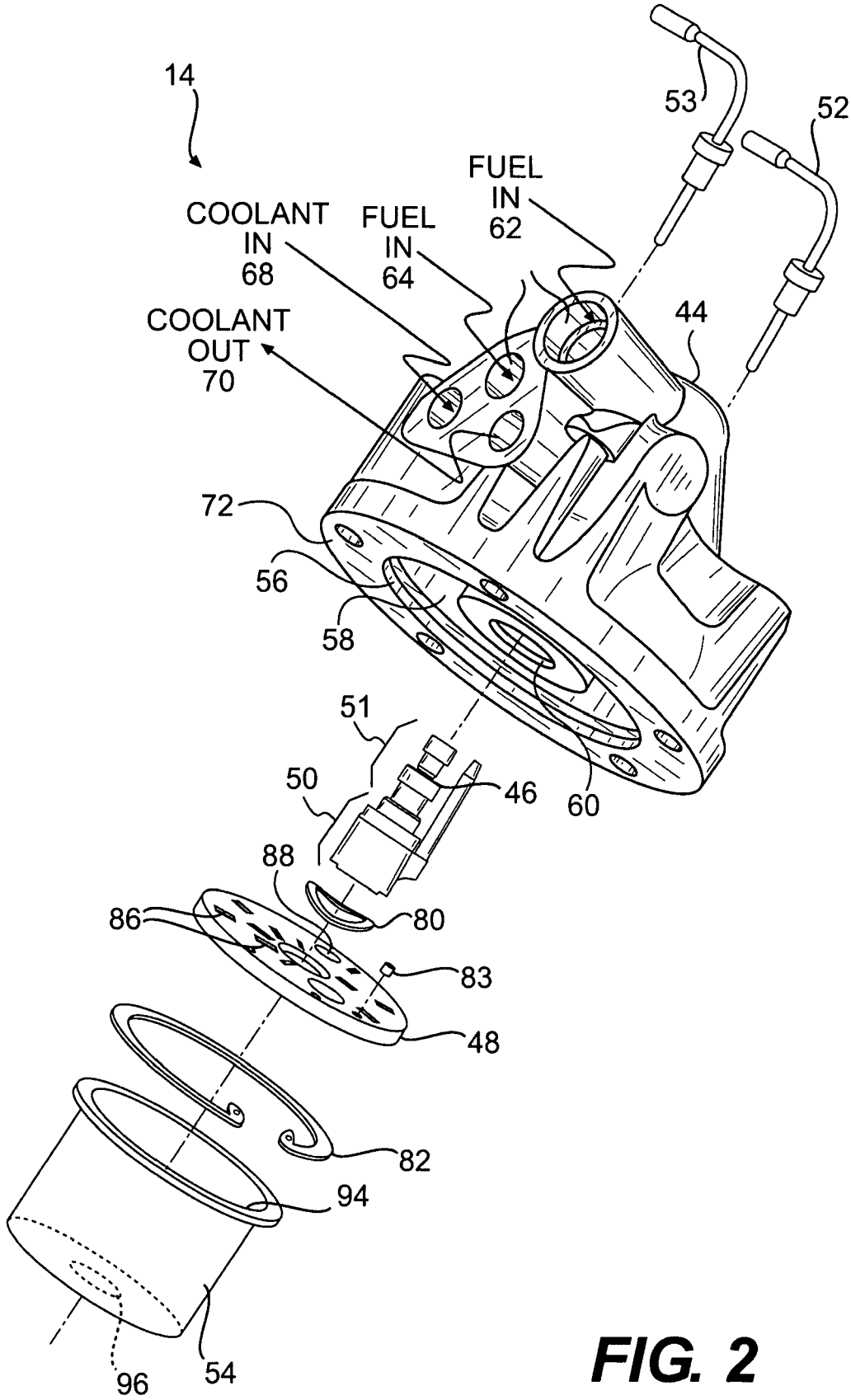
FIG. 2 is an exploded view illustration of an exemplary disclosed exhaust treatment device for use with the power unit of FIG. 1.

As illustrated in FIG. 2, auxiliary regeneration system 14 may include components that cooperate to periodically reduce the buildup of particulate matter within exhaust treatment device 40. These components may include, among other things, a housing 44, an injector 46, a mixing plate 48, a first thermocouple 52, a second thermocouple 53, and a combustion canister 54. It is contemplated that auxiliary regeneration system 14 may include additional or different components than those illustrated in FIG. 2, such as, for example, one or more pilot injectors, additional main injectors, a pressure sensor, a flow sensor, an exhaust flow blocking device, and other components known in the art. It is further contemplated that instead of or in addition to filtration medium 42, exhaust treatment device 40 may include a Selective Catalytic Reduction (SCR) device and an associated injector (not shown) nearly identical to injector 46 for introducing a reductant such as, for example, urea into the exhaust flow upstream of the SCR device.

Housing 44 may receive and fluidly interconnect injector 46, mixing plate 48, first thermocouple 52, and second thermocouple 53. In particular, housing 44 may have a central stepped bore 56, an annular recessed opening 58, a centrally located bore 60, and one or more radially offset bores (not shown). Housing 44 may also include a pilot fuel port 62, a main fuel port 64, and inlet and outer cooling ports 68 and 70, respectively. One or more check valves (not shown) may be associated with any one or all of these ports, if desired, to ensure unidirectional flow of the respective fluids through the ports and/or to minimize volumes thereof that could require periodic re-supplying or purging.

Centrally located bore 60 may receive injector 46 through an inner surface 72 (referring to the surface of housing 44 illustrated in FIG. 2 as being open to combustion canister 54). Centrally located bore 60, together with injector 46, may form a pilot fuel chamber 74 (referring to FIG. 3), a main fuel chamber 76, and a coolant chamber 78 within the steps of centrally located bore 60. Pilot fuel chamber 74 may fluidly communicate with pilot fuel port 62, while main fuel chamber 76 may fluidly communicate with main fuel port 64. Coolant chamber 78 may fluidly communicate with both the inlet and outer cooling ports 68, 70. Mixing plate 48 may retain injector 46 within centrally located bore 60 by way of a resilient member, such as, for example, a Bellville washer 80.

Central stepped bore 56 may receive mixing plate 48 also through inner surface 72. Mixing plate 48 may be press-fitted completely within central stepped bore 56 and/or held in place with a snap ring 82. Mixing plate 48 may be centrally aligned with injector 46 and housing 44, and angularly oriented with respect to housing 44 by way of one or more dowel pins 83.

The one or more radially offset bores may receive first thermocouple 52 and second thermocouple 53 through an external surface of housing 44. First thermocouple 52 and second thermocouple 53 may have external threads that engage internal threads of the corresponding radially offset bore. A terminal end of first thermocouple 52 may be located inside of or in contact with injector 46. A terminal end of second thermocouple 53 may extend into combustion canister 54 via a first through hole 88 in mixing plate 48.

Injector 46 may be operable to inject one or more amounts of pressurized fuel (e.g., pressurized diesel fuel) into combustion canister 54. Injector 46 may be disposed within housing 44 and may include an inlet end 51 and a nozzle end 50. Inlet end 51 of injector 46 may receive and direct fuel toward nozzle end 50. Specifically, inlet end 51 may include a plurality of passageways to communicate fuel to nozzle end 50. Separate passageways within injector 46 may be used to direct fuel from pilot fuel chamber 74 and main fuel chamber 76 to nozzle end 50 for pilot and main shots of fuel during an injection event.

Injector 46 may inject pressurized fluid at predetermined timings, fluid pressures, and fluid flow rates. For example, during an injection event, injector 46 may inject a pilot shot of fuel that may be followed by one or more main shots of fuel. The timing of fuel injection into combustion canister 54 may be synchronized with sensory input received from first thermocouple 52, second thermocouple 53, one or more pressure sensors (not shown), a timer (not shown), or any other similar sensory devices such that the injections of fuel substantially correspond with a buildup of particulate matter within filtration medium 42 (referring to FIG. 1). For example, the fuel may be injected as a function of a temperature at nozzle end 50 of injector 46 and a period of time at which nozzle end 50 of injector 46 has been maintained at the temperature (i.e., at or near the end of an injector purging event). It is contemplated that fuel may also be injected on a set periodic basis, in addition to or regardless of pressure and temperature conditions, if desired.

Mixing plate 48 (e.g., a swirl plate), together with annular recessed opening 58 of housing 44, may form an air distribution passage 84 (referring to FIG. 3), which may be supplied with compressed air via an air supply passage 66. Mixing plate 48 may include a plurality of annularly disposed air vents 86 fluidly communicating air distribution passage 84 with combustion canister 54. Air vents 86 may mix air with injections of fuel inside combustion canister 54 to improve combustion therein. It is contemplated that air vents 86 may additionally or alternatively direct pressurized air to the outer periphery of combustion canister 54 for cooling and/or insulating purposes, if desired.

First thermocouple 52 may measure the temperature within combustion canister 54. A thermocouple generally includes two dissimilar metals, often embodied in slender members such as wires or rods. The two metals of the thermocouple may be joined at a measuring end of the thermocouple (usually the terminal end) via a soldered junction. When the temperature at the measuring end of the thermocouple changes relative to the temperature at a reference end (i.e., non-measuring end), a measurable voltage is generated. The value of the measured voltage may be used to determine an absolute temperature at the measuring end of the thermocouple.

First thermocouple 52 may confirm successful ignition of the fuel/air mixture within combustion canister 54. When a temperature measured within combustion canister 54 exceeds a predetermined value, it may be concluded that ignition of the air-fuel mixture has been achieved. Similarly, when the temperature measured within combustion canister 54 drops below the predetermined value, it may be concluded that a flameout has occurred. As is described below, it is contemplated that injector 46 and/or the components that interact with injector 46 may operate in response to the temperature measured by first thermocouple 52 to maintain a steady flame and/or to avoid flameout. It is also contemplated that multiple thermocouples, or other sensors, such as infrared sensors, may be used to determine when the fuel within combustion canister 54 is ignited.

Second thermocouple 53 may be located to measure the temperature at nozzle end 50 of injector 46. The temperature measured by second thermocouple 53 may be used to control a purging event and/or to determine when nozzle end 50 of injector 46 has reached an ignition threshold temperature. The ignition threshold temperature may be any temperature sufficient to ignite injected fuel. For example, when the injected fuel is diesel fuel, the ignition threshold temperature may be approximately 450 degrees C.

Combustion canister 54 may embody a tubular member configured to axially direct an ignited fuel/air mixture (i.e., the flame) from auxiliary regeneration system 14 into the exhaust flow of exhaust treatment device 40. In particular, combustion canister 54 may include a central opening 94 that fluidly communicates fuel from injector 46 and air from air distribution passage 84 with the exhaust flow. Combustion canister 54 may employ a flame stabilizing plate 96 at one end of central opening 94 to provide a restriction that minimizes pulsations within exhaust treatment device 40. That is, an inner diameter of flame stabilizing plate 96 may be less than an inner diameter of central opening 94.

Figure 3:
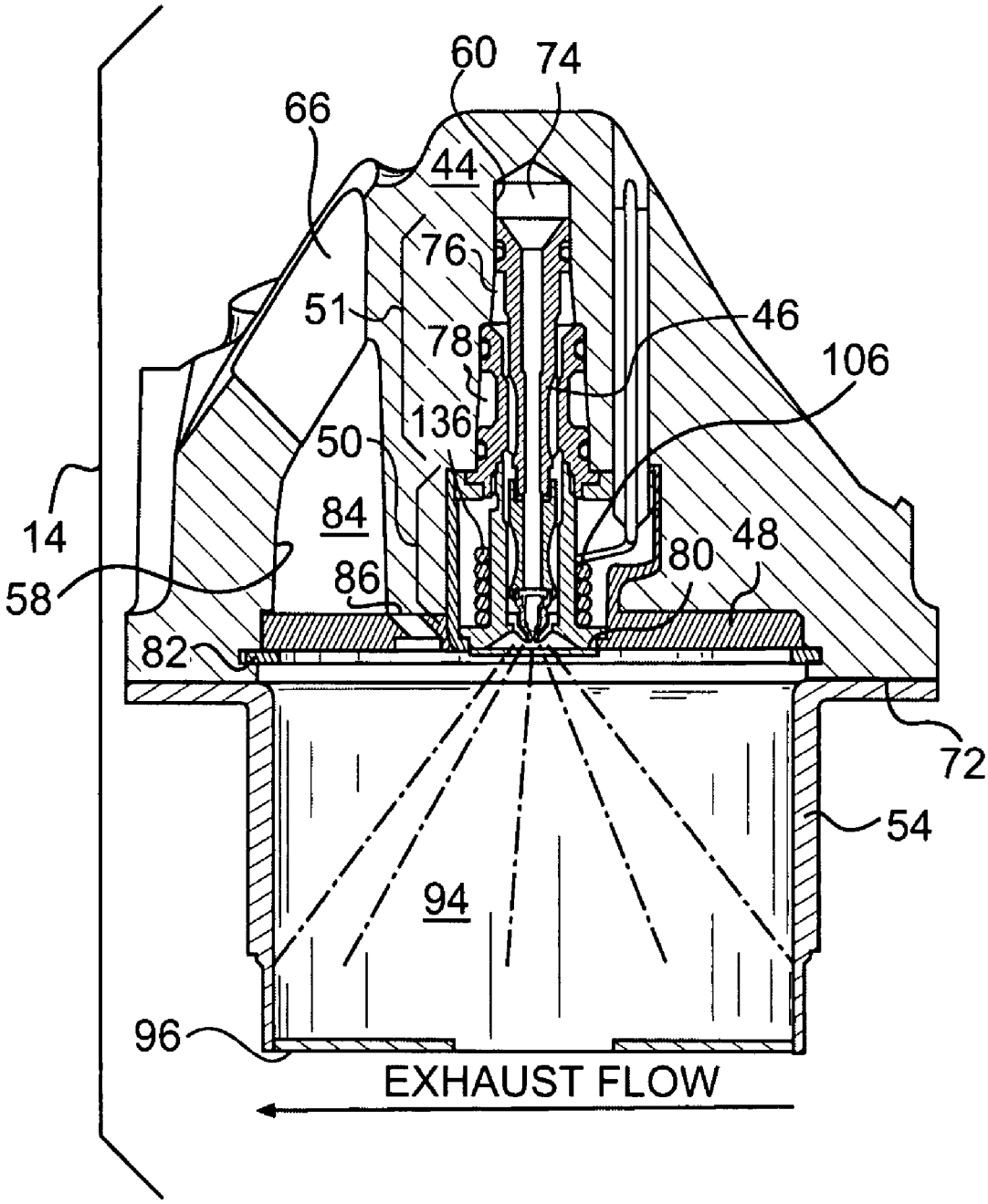
FIG. 3 is a cross-sectional illustration of the exhaust treatment device of FIG. 2.
Figure 4:
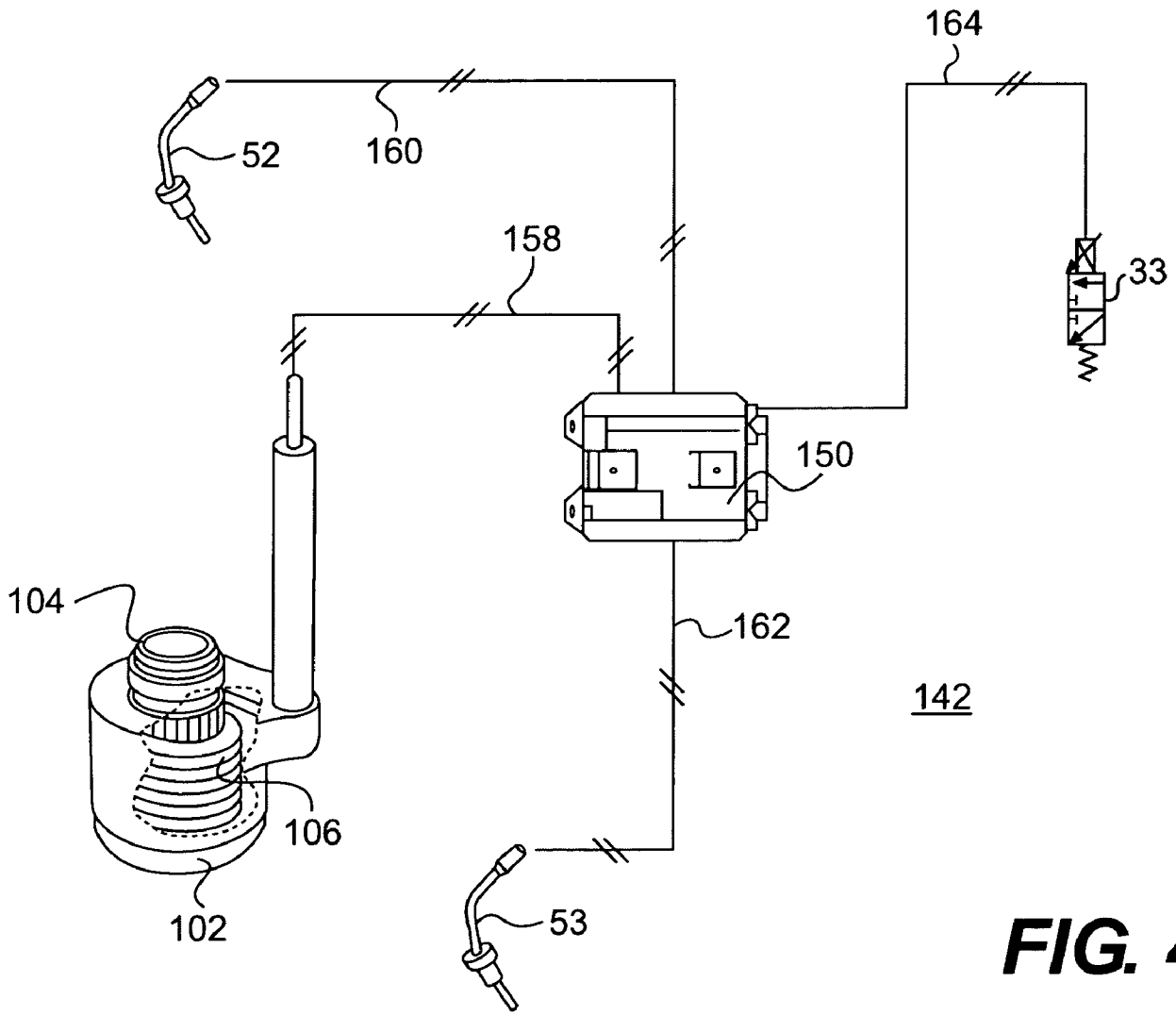
FIG. 4 is a schematic and diagrammatic illustration of an exemplary disclosed control system for use with the device of FIGS. 2 and 3.

As is shown in FIGS. 3 and 4, a control system 142 having a heater 106 may be used to ensure continued operation of injector 46, even under harsh operating conditions. Heater 106 may be located to heat nozzle end 50 of injector 46 to ignite injections of fuel during a regeneration event and to facilitate the purging of injector 46 between or just prior to regeneration events. Heater 106 may include an electrically resistive coil winding 136 disposed within a body that is press-fitted onto or otherwise joined to nozzle end 50 (referring to FIG. 3). As the current flows through the coil winding 136, heat may be generated.

The heat generated by coil winding 136 may be used to purge injector 46. Specifically, this heat generated by coil winding 136 may be conducted into and work to clear injector passageways of fuel residuals. Depending on the desired purge event, heater 106 may be activated to achieve differing temperatures for different purge heating periods. For example, if the purge event is immediately following a regeneration event, and only evaporation of residual fuel is desired, the temperature of the purge event may only be increased to about 300 degrees C. for about 10-15 min. In contrast, if the purge event is a standard periodic purge, the required temperature may be higher and the heating duration may be longer. For example, a periodic purge event may include temperatures of approximately 475 degrees C. that endure for a period of about 1 hr. If the purge event is associated with a failed regeneration event (i.e., injector 46 is plugged), the temperature of the purge event could be even higher and for a longer period of time. It is contemplated that heater 106 may also continuously warm injector 46 to a moderate temperature such that extreme temperature differentials are minimized and the time to reach purge temperature levels is reduced. It should be noted that the temperatures and durations described above are associated with diesel fuel, and the temperatures and durations may change if a different fuel (e.g., bio-diesel, gasoline, natural gas, etc.) is directed through injector 46. It should also be noted that the above described time durations are associated with an elapsed time at the appropriate temperature and not necessarily the time elapsed since start of the purge process.

Heater 106 may also facilitate ignition of fuel sprayed from injector 46 into combustion canister 54 during an injection event. Specifically, after a purging event, the temperature at nozzle end 50 of injector 46 may be at or above an ignition threshold temperature of the injected fuel (e.g., a temperature of approximately 450-500 degrees C. for diesel fuel). When the temperature at nozzle end 50 is at or above the ignition threshold temperature, a small quantity (i.e., a pilot shot) of fuel from injector 46 may be sprayed or otherwise injected into combustion canister 54. As the fuel passes the through nozzle end 50 of injector 46, the high temperatures at nozzle end 50 may ignite the fuel. This ignited fuel may create a flame, which may be jetted or otherwise advanced toward the trapped particulate matter. The flame propagating from injector 46 may raise the temperature within exhaust treatment device 40 to a level that readily supports efficient ignition of a larger quantity (i.e., a main shot) of fuel from injector 46. As the main shot of fuel ignites, the temperature within exhaust treatment device 40 may continue to rise to a level that causes combustion of the particulate matter trapped within filtration medium 42 and/or to a level that supports efficient operation of a catalyst. It is contemplated that the pilot and main shots may be discrete events or variable changes in a continuous metering of fuel. It is also contemplated that heater 106 and injector 46 may be activated independently of the purging event in order to achieve fuel ignition. This fuel ignition may be used to regenerate filtration medium 42.

Control system 142 may be utilized to regulate actuation of injector 46 (e.g., control injection events) and heater 106 (e.g., control purging events). Control system 142 may include a controller 150 in communication with heater 106, first thermocouple 52, second thermocouple 53, and fuel valve 33 via communication lines 158, 160, 162, and 164, respectively. It is also considered that control system 142 may communicate with an air supply pump (not shown) to control the flow of air into combustion canister 54, if desired. Controller 150 may regulate the temperature created by heater 106 and/or the flow rate of fuel to injector 46 based on input from first thermocouple 52, and/or second thermocouple 53. It is also contemplated that controller 150 may alternatively regulate the temperature created by heater 106 based on additional or different input, such as, for example, a temperature or pressure of coolant flowing through injector 46, a timer, and/or a rotational speed of power unit 10.

Controller 150 may embody a single microprocessor or multiple microprocessors that include a means for controlling injections of injector 46 and the operation of heater 106. Numerous commercially available microprocessors may be configured to perform the functions of controller 150. It should be appreciated that controller 150 may readily embody a general power unit microprocessor capable of controlling numerous power unit functions. It is also considered that controller 150 may consist of analog circuitry arranged to control the events and operations associated with injector 46 and heater 106. Various other known circuits may be associated with controller 150, including power supply circuitry, signal-conditioning circuitry, signal amplification circuitry, and other appropriate circuitry.

Controller 150 may include one or more maps stored within an internal memory of controller 150 and may reference these maps to determine a temperature, a heating duration, and/or a current associated with the activation of heater 106 for various purging events. Controller 150 may also include one or more maps to determine a temperature, a heating duration, a needed current and/or an injector flow rate to effect various injection events that result in a regeneration of filtration medium 42. Each of these maps may include a collection of data in the form of tables, graphs, and/or equations.

Controller 150 may direct a predetermined or generated current waveform to heater 106 at the appropriate timing to achieve the desired temperature for the desired heating duration. In one example, controller 150 may regulate the operation of heater 106 in an open loop routine based on the data from the maps described above. Alternatively, controller 150 may regulate the operation of heater 106 in a closed loop routine based on the data from the maps and input from first thermocouple 52, second thermocouple 53 and/or other sources, if desired. For the purposes of this disclosure, the combination of current levels induced within heater 106 and the durations thereof used to produce a single purge event or ignition of fuel during an injection event may be considered a current waveform.

Controller 150 may use any control method such as, bang-bang control, proportional control, proportional integral derivative control, adaptive control, model-based control, logic-based control, or any other control method known in the art. Controller 150 may use feedforward or feedback control.

Controller 150 may send predetermined or generated waveforms to heater 106 and/or fuel valve 33 in response to receiving or recognizing a trigger. Specifically, controller 150 may activate and control heater 106 to effect a purging event in response to the end of a successful regeneration event, in response to a failed regeneration event indicating clogging of injector 46, and/or in response to an elapsed period of time since a previous purging event.

Controller 150 may also activate and control heater 106 and/or fuel valve 33 to effect an injection event (resulting in ignition of injected fuel) in response to a trigger. For example, heater 106 achieving a desired ignition threshold temperature may activate an injection event by moving fuel valve 33 to an open position that results in a pilot shot of fuel being injected. It is also contemplated that a successful purging event, in combination with heater 106 achieving a desired ignition threshold temperature, may trigger an injection event. It is contemplated that the ignition threshold temperature may be directly measured via second thermocouple 53, or may be predicted using data from the one or more maps described above.

Controller 150 may also modulate a characteristic of the injection and heating events, such as the degree of actuation of heater 106, fuel valve 33, and/or the air supply pump (if present) to maintain a stable flame or in response to a predicted or detected flameout. Controller 150 may use feedback from a sensor, such as first thermocouple 52, to determine if the injected fuel is combusting within combustion canister 54. Controller 150 may maintain a stable flame until the regeneration event is completed. It is contemplated that other and/or a combination of triggers may be utilized to initiate purging, and/or injection events, if desired.

Figure 5:
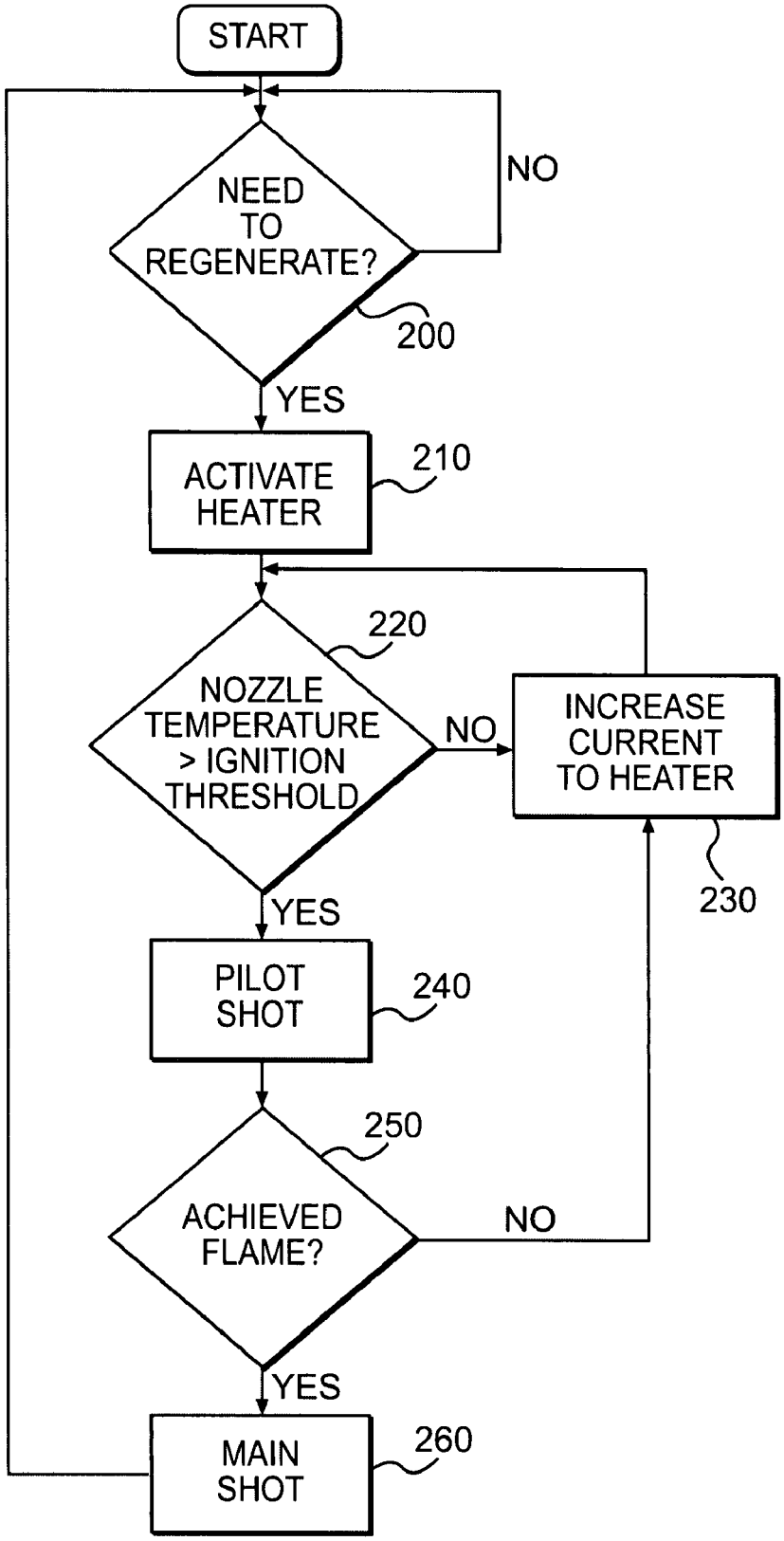
FIG. 5 is a flowchart depicting an exemplary method performed by the control system of FIG. 4 to purge the exhaust treatment device of FIGS. 2 and 3.

FIG. 5 illustrates an exemplary method of operating injector 46 during injection, ignition and purge events. FIG. 5 will be describe in detail in the following section to better illustrate the disclosed system and its operation.

INDUSTRIAL APPLICABILITY

The regeneration system of the present disclosure may be applicable to a variety of fuel injecting systems including, for example, regeneration devices associated with particulate traps requiring periodic oxidation of trapped particulate matter, catalytic converters requiring a predetermined temperature for optimal operation, and other similar devices known in the art. In fact, the disclosed regeneration system may be implemented into any fuel injecting system that may benefit from a single means for both cleaning and ignition. The operation of power unit 10 will now be explained.

Referring to FIG. 1, air and fuel may be drawn into combustion chambers 17 of power unit 10 for subsequent combustion. Specifically, fuel from fuel system 12 may be injected into combustion chambers 17 of power unit 10, mixed with the air therein, and combusted to produce a mechanical work output and an exhaust flow of hot gases. The exhaust flow may contain a complex mixture of air pollutants composed of gaseous and solid material, which can include particulate matter. As this particulate laden exhaust flow is directed from combustion chambers 17 through exhaust treatment device 40, particulate matter may be removed from the exhaust flow by filtration medium 42. Over time, the particulate matter may build up in filtration medium 42 and, if left unchecked, the buildup may restrict, or even block the flow of exhaust through exhaust treatment device 40. As indicated above, the restriction of exhaust flow from power unit 10 may increase the backpressure of power unit 10 and reduce the power unit's ability to draw in fresh air, resulting in decreased performance of power unit 10, increased exhaust temperatures, and poor fuel consumption.

To prevent the undesired buildup of particulate matter within exhaust treatment device 40, filtration medium 42 may be regenerated. The method of FIG. 5 may be activated when a need for regeneration exists (step 200). Regeneration may be periodic or based on a triggering condition, such as, for example, an elapsed time of engine operation, a pressure differential measured across filtration medium 42, a temperature of the exhaust flowing from power unit 10, or any other condition or combination of conditions known in the art. If regeneration is needed, heater 106 may be activated (step 210) to heat nozzle end 50 to the ignition threshold temperature of the subsequently injected fuel.

The temperature at nozzle end 50 of injector 46 may be measured via second thermocouple 53 (step 220) during the heating of nozzle end 50. When the temperature at nozzle end 50 is above the ignition threshold temperature of the injected fluid, a pilot shot of the fluid may be injected by injector 46 (step 240). In the alternative, if the temperature at nozzle end 50 is below the ignition threshold temperature, controller 150 may increase the quantity of current supplied to heater 106 (step 230) and/or the duration of the applied current. The temperature at nozzle end 50 may be compared again to the ignition threshold temperature (step 220), and this process may be repeated until the temperature at nozzle end 50 is at or above the ignition threshold temperature.

After injector 46 injects the pilot shot of fuel (step 240), first thermocouple 52 and/or other flame sensors may be used to determine if ignition of the injected fuel has occurred (step 250). If a flame has been achieved, a main shot of fuel may be injected (step 260). The main shot of fuel may continue for an appropriate regeneration heating period (i.e., the time required to regenerate medium 42) or until the regeneration triggering condition is no longer satisfied. If a flame has not been achieved, the method may return to increasing the current to and/or the heating duration of heater 106 (step 230). It is also contemplated that the amount of injected fuel may be modified in response to unsuccessful ignition.

It is contemplated that after several regeneration events, injector 46 may become clogged with particulate matter and fuel residue. When injector 46 becomes clogged, heater 106 may be activated to attain a sufficient temperature within injector 46 for a sufficient time to effect a purging event. It is also contemplated that the temperature at the conclusion of a purge event may be sufficient to ignite fuel of a subsequent injection event. In this case, controller 150 would activate heater 106 (step 210) for a sufficient time such as to effect a purging event, and then controller 150 would move forward in the regeneration process by verifying that the temperature of nozzle end 50 achieved during the purging event was sufficient to ignite the injected fuel (step 220), and so on.

During the main shot of fuel, control of the air/fuel mixture may be required to maintain a stable flame and/or avoid flameout. This may require modification of the air supplied via the air supply pump (if present), fuel supplied via injector 46, and the temperature at nozzle end 50 elevated via heater 106. It is also considered that, alternatively, initial ignition of the injected fuel and/or continued stable combustion may be achieved with open loop control, and without real time feedback.

Because the disclosed injector may require only a single means for heating the injector and for igniting the injected fuel, component cost and assembly time for the disclosed injector and the components associated with operation of the injector may be decreased. Furthermore, the disclosed auxiliary regeneration system may actuate the injector and/or heater to effect a filter regeneration in a sustainable and controllable manner.

It will be apparent to those skilled in the art that various modifications and variations can be made to the regeneration system of the present disclosure without departing from the scope of the disclosure. Other embodiments will be apparent to those skilled in the art from consideration of the specification and practice of the regeneration system disclosed herein. For example, although the disclosed injector is illustrated as drawing pressurized fuel from a fuel system, the disclosed injector may alternatively draw pressurized fuel from a separate dedicated source, if desired. In addition, it is contemplated that the disclosed heater and control system may be combined with an air- or chemical-purging system to more effectively remove liquid fuel and/or residue from the disclosed injector, if desired. It is intended that the specification and examples be considered as exemplary only, with a true scope of the disclosure being indicated by the following claims and their equivalents.

What is claimed is:

1. A regeneration device configured for use with a combustion engine, comprising:

an injector configured to inject pressurized fuel during an injection event;

a heater located at a nozzle end of the injector; and a controller in communication with the heater and the injector, the controller being configured to:

operate the heater in order to ignite the pressurized fuel during the injection event; and operate the heater in order to purge the injector between injection events.

2. The regeneration device of claim 1, wherein the heater is a coil winding, wherein the coil winding is circumferentially located about the nozzle end of the injector to heat the nozzle end of the injector.

3. The regeneration device of claim 2, wherein the heater is an electric heater.

4. The regeneration device of claim 1, wherein the injection event includes a pilot shot of fuel and a main shot of fuel.

5. The regeneration device of claim 4, wherein the injector injects the pilot shot of fuel when the nozzle end of the injector is above an ignition threshold temperature.

6. The regeneration device of claim 5, wherein the ignition threshold temperature is achieved as a result of a purging event.

7. The regeneration device of claim 5, wherein the ignition threshold temperature is achieved by operating the heater independently from a purging event.

8. The regeneration device of claim 5, wherein the ignition threshold temperature is greater than about 450 degrees Celsius.

9. The regeneration device of claim 1, further including a sensor configured to detect a flameout during the injection event.

10. The regeneration device of claim 9, wherein an operational characteristic of at least one of the injector and the heater is varied in response to a detected flameout.

11. The regeneration device of claim 10, wherein at least one of an amount of supplied fuel, an amount of supplied air, and a temperature at the nozzle end of the injector is varied in response to a detected flameout.

12. The regeneration device of claim 1, wherein the injection event is performed by way of open loop control.

13. A method of operating a regeneration device including an injector, comprising:

receiving a flow of exhaust from a combustion engine via a passageway, the regeneration device being coupled to the passageway;

pressurizing fuel;

injecting the pressurized fuel during an injection event with the injector;

heating the injector to ignite the fuel in order to regenerate a filtration medium located in the passageway; and heating the injector to purge the injector of fuel, residue, or particulate matter between injection events.

14. The method of claim 13, wherein heating the injector includes heating a nozzle end of the injector.

15. The method of claim 14, wherein injecting the pressurized fuel includes injecting a pilot shot of fuel and injecting a main shot of fuel.

16. The method of claim 15, wherein the pilot shot of fuel is injected when the nozzle end of the injector is heated above an ignition threshold temperature.

17. The method of claim 15, further including sensing a flameout during the injection event.

18. The method of claim 17, further including varying a characteristic of at least one of the injecting and the heating in response to a detected flameout.

19. A regeneration system for use with a combustion engine, comprising:

a passageway configured to receive a flow of exhaust from the combustion engine;

a filtration medium situated to remove particulate matter from the flow of exhaust;

an injector configured to inject pressurized fuel into the flow of exhaust upstream of the filtration medium during an injection event to regenerate the filtration medium;

a heater associated with the injector; and a controller configured to operate the heater to ignite the injected pressurized fuel during the injection event, the controller also being configured to operate the heater to purge the injector between injection events by way of heating.

20. The regeneration system of claim 19, further including a sensor configured to detect flameout, and wherein the controller is in communication with the sensor and the injector to control the injection and purging events in response to a detected flameout.

* * * * *